United States Patent [19]

Rilbe

[11] 4,060,221

[45] Nov. 29, 1977

[54] DOUBLE-ACTING HYDRAULIC CYLINDER HAVING TWO PISTONS ARRANGED FOR COAXIAL MOVEMENT RELATIVE THERETO

[75] Inventor: Ulf Christer Rilbe, Hudiksvall, Sweden

[73] Assignee: Hiab-Foco Aktiebolag, Hudiksvall, Sweden

[21] Appl. No.: 762,836

[22] Filed: Jan. 27, 1977

[30] Foreign Application Priority Data

Feb. 3, 1976 Sweden ..... 7601122

[51] Int. Cl.[2] ..... F01B 7/20

[52] U.S. Cl. ..... 254/93 R; 92/53

[58] Field of Search ..... 92/50, 52, 53, 69, 75; 91/189 R, 189 A; 254/93 R

[56] References Cited

U.S. PATENT DOCUMENTS 3,877,349 4/1975 Schindel ..... 92/53

*Primary Examiner*—Robert C. Watson

*Attorney, Agent, or Firm*—Newton, Hopkins & Ormsby

[57] ABSTRACT

A double-acting hydraulic cylinder having two concentrically disposed jackets and at least two pistons arranged for coaxial movements relative to said cylinder, one of said pistons being annular and arranged for axial movement in an annular chamber, means being provided to communicate a space between the inner piston and an end section of the inner jacket, with the opposite end of the annular chamber in a manner ensuring that the operative, pressurized medium actuates the two pistons for displacement thereof in a predetermined order and at approximately the same speed in the outwards and inwards directions of said pistons.

1 Claim, 5 Drawing Figures

DOUBLE-ACTING HYDRAULIC CYLINDER HAVING TWO PISTONS ARRANGED FOR COAXIAL MOVEMENT RELATIVE THERETO

BACKGROUND OF THE INVENTION

In existing hydraulic cylinders intended for telescopically displaceable crane arms and comprising two pistons which are movable coaxially relative to their cylinder, the end surface of the larger piston has a size which is equal to the inner end surface of the cylinder jacket. The return side of the piston, on the other hand, has a considerably smaller operative surface. When a hydraulic cylinder of this kind is used to increase or reduce the range of a telescopically movable crane boom, it is necessary that each piston moves at essentially the same speed, both in the outwards and the inwards directions. This requirement cannot be satisfied, as the above-mentioned large difference in piston surfaces at the front and rear sides of the piston means that if the fluid volumes are equal, the piston is imparted a considerably higher speed in the inwards direction than in the outwards direction. As a consequence of this increase of speed, a large volume of return oil must likewise be forced out of the cylinder in a limited period of time, which means that the flow velocity in the conduits increases to critical values, unless the conduits are dimensioned to accommodate the larger fluid quantities. However, it is expensive to have to oversize tubes and pipe conduits.

Upon rapid piston movements outwards, such as is the case when the crane boom is directed downwards and the load is heavy, one consequence of the large piston surface differential may be that there is not enough time to allow a sufficient quantity of oil to refill the piston return side in the cylinder, and therefore a vacuum may generate in this area, causing the piston, during its return movements, to strike back across the "void" in an uncontrolled manner. This constitutes an element of risk to the crane operator and anybody in the immediate vicinity of the crane. In addition, cavitation damages may occur.

SUMMARY OF THE INVENTION

The purpose of the present invention which relates to hydraulic cylinders of the type mentioned, is primarily to remedy the deficiencies outlined above. More precisely the invention concerns a double-acting hydraulic cylinder having two concentrically arranged jackets forming between them an annular chamber at the ends of which are provided pressure-fluid inlet and outlet ports and in which chamber is axially movable an annular piston having a tubular piston rod which is arranged for axial displacement in a sealed annular gap formed between one of the end sections of the annular chamber and the inner jacket, wherein a second piston is arranged for axial movement.

Another purpose of the subject invention is to ensure, in a double-acting hydraulic cylinder of this type intended to drive e.g. a telescopically movable arm, that each one of the two pistons, the movements of which are independent of one another, is displaced at essentially the same speed when moving outwards and when moving inwards, while at the same time is ensured that the pistons are displaced in the correct order, i.e. that when the telescopic arm is moved outwards, the outer piston is first displaced outwards and then the inner piston, while when the telescopic arm is moved inwards, first the inner piston and then the outer piston are displaced inwards. This effect is obtained in accordance with the present invention in that the inner jacket is provided with a bottom section and that the opposite one of the end sections of the cylinder is provided with a pressure medium inlet and outlet port adjacent the inner jacket end positioned in this area, that this jacket is provided adjacent said bottom section thereof with openings through which the end of the annular chamber that is positioned between said opposite end section and the annular piston, communicates with the space of the inner jacket that is located between the bottom section and the inner piston, and in that between the annular piston and the inner jacket is formed an annular gap which communicates with said openings.

Owing to this arrangement, the relative speeds of the outer piston, i.e. the annular piston, and the cylinder are approximately equal during outwards and inwards movements. In addition, the pressurized oil supplied to the cylinder and the return oil withdrawn therefrom will flow at essentially the same speed.

BRIEF DESCRIPTION OF THE DRAWINGS

Additional characteristics of the invention will appear from the following description with reference to the accompanying drawings, wherein.

DETAILED DESCRIPTION OF A PREFERRED EMBODIMENT

Figure 1:
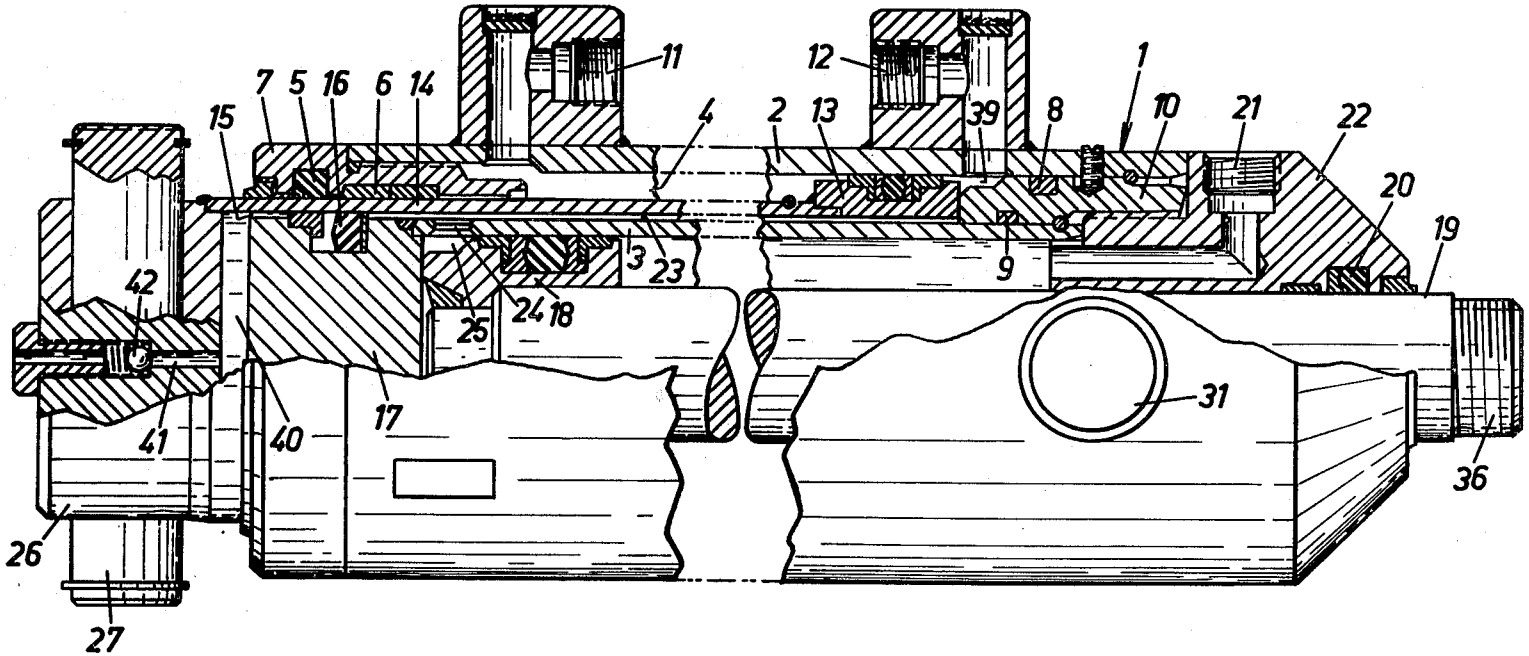
FIG. 1 illustrates, partly in an axial longitudinal sectional view, a broken side view of a double-acting hydraulic cylinder in accordance with the invention, comprising two pistons which are displaceable coaxially relative to the cylinder.

The hydraulic cylinder 1 illustrated in the drawings comprises an outer jacket 2 and an inner jcket 3 arranged coaxially with the inner jacket but having an outer diameter which is smaller than the inner diameter of the outer jacket, whereby an annular chamber 4 is formed between the jackets 2 and 3. At one end of the outer jacket, the left end, is attached an end section 7 which is provided with sealing rings 5, 6, and at the opposite end, between the outer jacket 2 and the inner jacket 3, is disposed an end section 10 provided with sealing rings 8 and 9. At the ends of the outer jacket 2 are arranged ports 11, 12 for outlet and inlet of a pressurized medium, in this case pressurized oil. An annular piston 13 is arranged for axial displacement in the annular chamber 4 and is provided with a tubular piston rod 14 which is displaceable in an annular gap 15 formed between the end section 7 and a bottom section 17 of the inner jacket 3, said bottom section provided with sealing rings 16. Inside this jacket is axially displaceable a piston 18 having a piston rod 19 which passes through an end piece 22 provided with sealing rings 20 and with an outlet and inlet port 21 for pressurized medium. The piston rod 14 has an inner diameter which is somewhat larger than the outer diameter of the inner jacket 3, whereby an annular gap 23 is formed between these two parts, and adjacent the bottom section 17, the inner jacket 3 is formed with openings 24 through which openings the space 25 formed between the bottom section 17 and the piston 18 inside the inner jacket 3 communicates with the annular chamber 4 and the annular gap 23.

Figure 3:
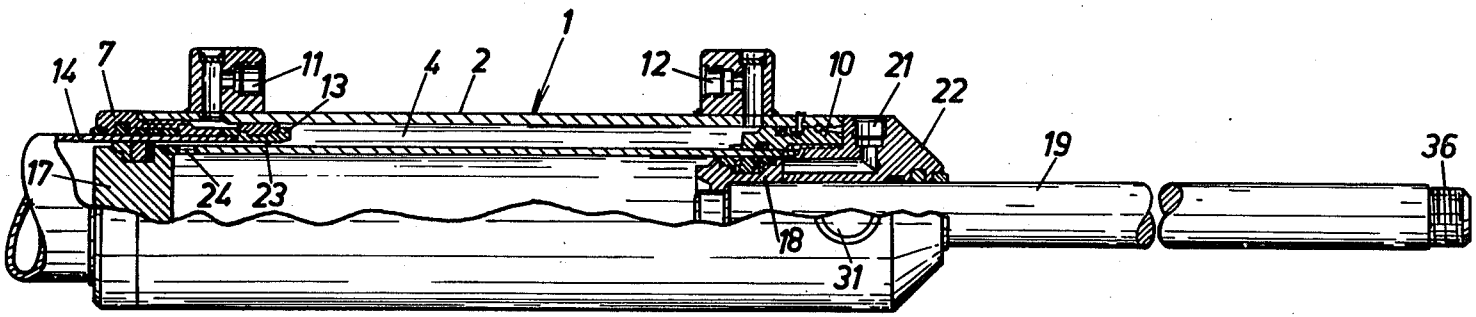
Figure 4:
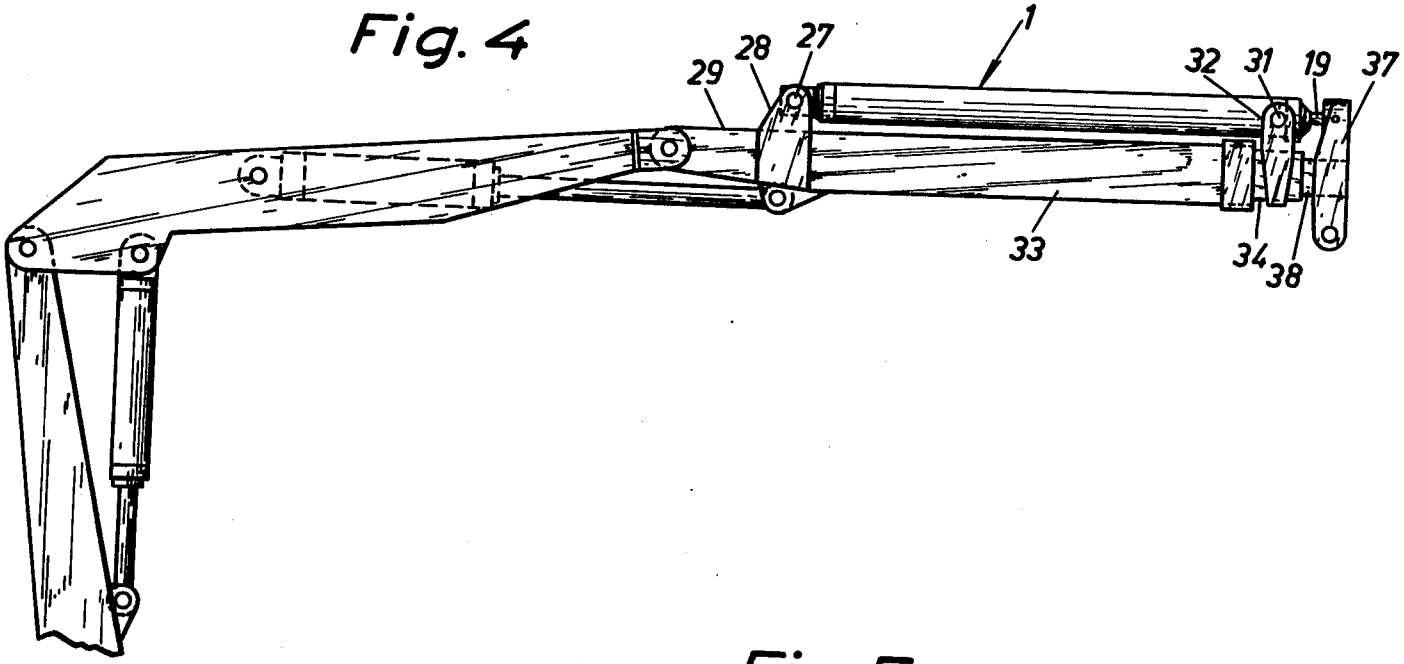
FIG. 4 is a side view of a crane incorporating the hydraulic cylinder in accordance with the subject invention positioned on the telescopic arm of the crane.
Figure 5:
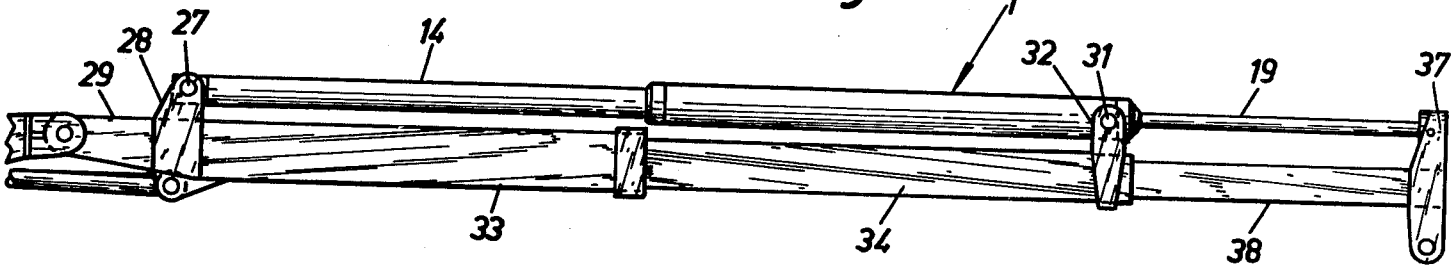
FIG. 5 is a similar view showing the hydraulic cylinder and the pistons thereof in the positions corresponding to those shown in FIG. 3.

The outer (left) end of the piston rod 14 which is closed by an end piece 26, is provided with a transverse shaft 27 securing the piston rod 14 to a fork-shaped attachment 28 (FIG. 4) on the rocker arm 29 of a loading crane (of which only the upper part is shown in FIGS. 4 and 5). The hydraulic cylinder 1 is provided with two transverse, coaxial pins 31 by means of which the cylinder may be attached to a fork-shaped attachment 32 on the outer end (the right-hand end in accordance with FIGS. 3 and 4) of a telescopic part 34 arranged for movement in the rocker arm 29 or in a tubular sleeve 33 secured on one side of said arm. The outer (right-hand) end 36 of the piston rod 19 may be secured to a head 37 provided on a telescopic part 38 which is axially displaceable in the telescopic part 34. In the head 37 is intended to be suspended the load to be lifted by the crane.

When the telescopic parts 34 and 38 are to be pushed out of the tubular sleeve 33 to increase the range of the crane, oil which is supplied to a (not illustrated) pressurized oil container by a pump, is forced through the inlet port 12 to the annular chamber 4 in the space 39 between the annular piston 13 and the end section 10. This forces the cylinder 1 to move to the right, bringing along its telescopic part 34, whereby return oil is forced from the annular chamber behind the annular piston 13, out through the outlet port 11. Only a portion of the quantity of oil forced through the inlet port 12 to the annular chamber 4 is forced through the annular gap 23 and through the openings into the cylinder chamber 25, which means that also the piston 18 and the piston rod 19 thereof are displaced to the right, bringing along the outer telescopic part 38. Return oil ahead of the piston 18 is drained through the outlet port 21 to the pressure vessel.

Because of the resistance which the oil encounters in the annular channel 23 is ensured that the cylinder 1 will have completed its outwards movement before the piston 18 has completed its outward movement. This order of movements is important in order to allow a load limit device incorporated into the crane to operate in the intended manner without risk of excess load on the comparatively weak piston rod 19.

Figure 2:
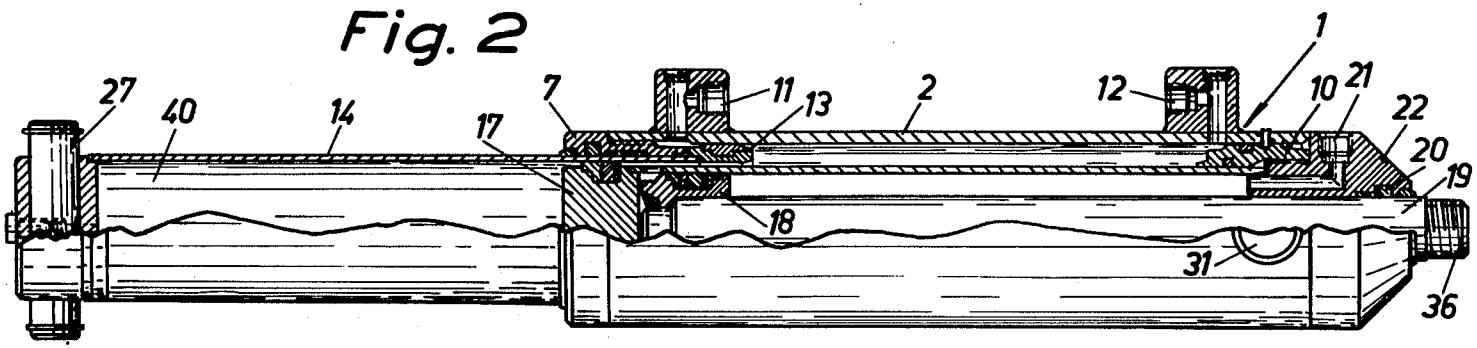
FIGS. 2 and 3 illustrate on a slightly smaller scale the same views but with the cylinder moved to the far right on the stationary, larger piston and the smaller piston displaced to the right in the cylinder.

When the telescopic parts 34 and 38 are to be returned to their initial positions (FIG. 4), pressurized oil is introduced through the inlet port 21. The piston 18 together with the piston rod 19 thereof are thereby forced to the left, bringing along the outer telescopic part 38. Return oil is forced from the space 25 via the openings 24 and the annular gap 23 into the annular chamber 4 in the space 39 between the annular piston 13 and the end section 10, and is drained through the outlet port 12 to the pressure vessel. At the same time—or preferably a brief period after the application of the oil pressure in the inlet port 21—oil is forced through the inlet port 11 into the annular chamber 4, with the result that the cylinder 1 is displaced to the left from the position illustrated in FIG. 2, bringing along its telescopic part 34 (FIG. 4).

In order to ensure that as a consequence of this return movement also piston 18 and the piston rod 19 thereof complete their inward movements before the cylinder 1 has completed its inward movement, it is preferable to provide valves in the inlet and outlet ports 11, 12, 21 to regulate the pressure and the flow, which is easily done with the structure in accordance with the invention.

In order to allow evacuation of the air present in a space 40 formed in the piston rod 14 between the end piece 26 thereof and the bottom section 17 of the inner jacket 3, when the cylinder 1 is displaced to the left, the end piece is provided with a channel 41 which is normally closed by a spring-loaded ball valve 42 but opens at the occurrence of an excess pressure in the space 40.

The hydraulic cylinder 1 as illustrated and described is to be regarded as an example only and its various parts may be structurally altered in a variety of ways within the scope of the invention. The piston 18 may be replaced by an annular piston arranged in an annular chamber in a manner similar to the one described above concerning the annular piston 13. It is likewise possible to arrange an annular piston of this kind between the annular piston 13 and the piston 18 in order to be able to increase the number of the telescopic parts 34 and 38. The hydraulic cylinder in accordance with the invention may be used for other purposes than telescopic crane booms.

What I claim is:

1. A double acting hydraulic cylinder unit having two concentrically arranged jackets forming between them an annular chamber, inlet and outlet ports for the admission and withdrawal of a pressurized medium provided at the ends of the annular chamber, an annular piston arranged for axial movement in said annular chamber, said annular chamber having a first end section, there being an annular gap formed between said first end section and the innermost one of said jackets, said annular piston having a tubular piston rod arranged for axial displacement in said annular gap, and a second piston arranged for axial displacement inside of said innermost jacket, the improvement comprising a bottom section in the innermost jacket, means forming an inlet and outlet port for said pressurized medium at the opposite end of said innermost jacket, there being aperture means provided near and inwardly of said bottom section of the innermost jacket and through the side wall thereof, there being first and second end spaces in said annular chamber and in the innermost jacket which communicate through said aperture means, said first end space of said annular chamber being between said annular piston and an adjacent end section of the outermost of said jackets and the second end space disposed between said bottom section of the innermost jacket and said second piston, there being another annular gap between said annular piston and said innermost jacket, the last-named annular gap communicating with said aperture means, a seal disposed between said tubular piston rod and said bottom section of said innermost jacket, said bottom section closing one end of said innermost jacket and defining one end wall of a space at the outer end of said tubular piston rod, an end closure piece on the tubular piston rod defining an opposing wall of said space, and said space having communication with the atmosphere.

* * * * *